US005857669A

United States Patent [19]

Ruggiero

[11] Patent Number: 5,857,669

[45] Date of Patent: Jan. 12, 1999

[54] METHOD AND APPARATUS FOR HIGH SPEED MERGING OF SHEET MATERIAL ONTO A TRANSPORT FROM THE SIDE

[75] Inventor: Ralph Ruggiero, Tucson, Ariz.

[73] Assignee: Bell & Howell Cope Company, Tucson, Ariz.

[21] Appl. No.: 728,842

[22] Filed: Oct. 10, 1996

[51] Int. Cl.[6] ..... B65H 39/02

[52] U.S. Cl. ..... 270/58.01; 270/45

[58] Field of Search ..... 270/52.01, 58.01, 270/45

[56] References Cited

U.S. PATENT DOCUMENTS

| | | | |
|---|---|---|---|
| 2,479,060 | 8/1949 | Davidson . | |
| 3,054,612 | 9/1962 | Godlewski . | |
| 3,158,366 | 11/1964 | Godlewski . | |
| 4,234,178 | 11/1980 | Beckert et al. . | |
| 4,577,848 | 3/1986 | Hams . | |
| 4,795,143 | 1/1989 | Tsai | 270/58.01 X |
| 4,875,668 | 10/1989 | Spyra . | |
| 5,141,216 | 8/1992 | Ballestrazzi et al. . | |
| 5,489,092 | 2/1996 | Kimura et al. | 270/58.01 X |
| 5,623,722 | 4/1997 | Hawley et al. | 270/58.01 X |

*Primary Examiner*—Hoang Nguyen
*Attorney, Agent, or Firm*—Patula & Associates

[57] ABSTRACT

A method and apparatus for high speed merging of sheet material onto a transport from the side is disclosed. The apparatus includes a pocket formed from a series of bottom guides, a series of top guides, a side restrain, a front and rear backstop, all mounted to a framework and being mounted slightly above a transport via a provision. A source feeds insert material into the pocket at which time the insert material is held therein until advancing transport picks engage the insert as the picks pass through slots in the pocket and propel the insert out of the pocket and on to the transport or an existing sheet already on the transport. Paper control devices are positioned within the pocket to dampen bounce and help keep the insert contained in the pocket.

21 Claims, 3 Drawing Sheets

METHOD AND APPARATUS FOR HIGH SPEED MERGING OF SHEET MATERIAL ONTO A TRANSPORT FROM THE SIDE

The present invention relates to a sheet transport system and in particular to a method and apparatus for high speed merging of sheet material onto a transport from the side. Specifically, the present inventions relates to a merge pocket for receiving sheet material at a right angle to the transport and allowing the merged sheet to be carried along the transport without having damaged the sheet material.

BACKGROUND OF THE INVENTION

High speed sheet transports, for example those used in a mail processing machine propel sheets at space intervals along a transport at very high speeds. It is necessary during this process to add sheet material or inserts onto those sheets being propelled along the transport. One known method for providing inserts onto a transport is to drop the insert onto the transport from above. Such a method is disclosed in U.S. Pat. No. 4,815,668 issued to Spira on Oct. 24, 1989 and assigned to the assignee of the present invention and which is herein incorporated by reference. However, such top loading systems are disadvantageous for a number of reasons.

For example, such systems are extremely complicated and take up alot of space and prevent access to the transport. Additionally, such systems are at times difficult to control. It may be difficult to drop single sheet inserts onto the high speed transport between the picks of the transport which propel sheet material on the transport at spaced intervals. Further, the inserts being dropped on the transport may not be properly positioned or aligned and could result in bending of the edges or even may jam the transport thus causing costly delays.

Accordingly, there is a need to provide for an improved method and apparatus for merging inserts onto a transport. The present invention solves the problems of the known insert methods by allowing paper to be fed into the transport from the side of the transport between picks. The present invention thus allows sheet material from two streams to be merged and stacked evenly without damage to the edges.

BRIEF SUMMARY OF THE INVENTION

The present invention comprises a merge pocket positioned just above the transport and capable of receiving sheet material or inserts from the side at right angles to the transport. The merge pocket comprises a series of bottom guides, top guides, side restraints, and rear and front backstops. The inserts are fed from any suitable source into the merge pocket than are precisely held therein until removed from the pocket by the transport picks.

Accordingly, it is a principal object of the present invention to provide a method and apparatus for high speed merging of sheet material onto a transport from the side.

It is a further object of the invention to provide a right angle merge pocket for receiving and positioning the inserts to be moved along the transport.

It is also an object of the invention to provide a method and apparatus for merging inserts onto a transport without damaging the inserts.

It is an additional object of the present invention to provide a method and apparatus for merging inserts onto a transport with improved control thereof.

It is another object of the present invention to provide a right angle merge pocket for inserts that provides better spacing and allows better access along the transport.

Numerous other advantages and features of the invention will become readily apparent from the detailed description of the preferred embodiment of the invention from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
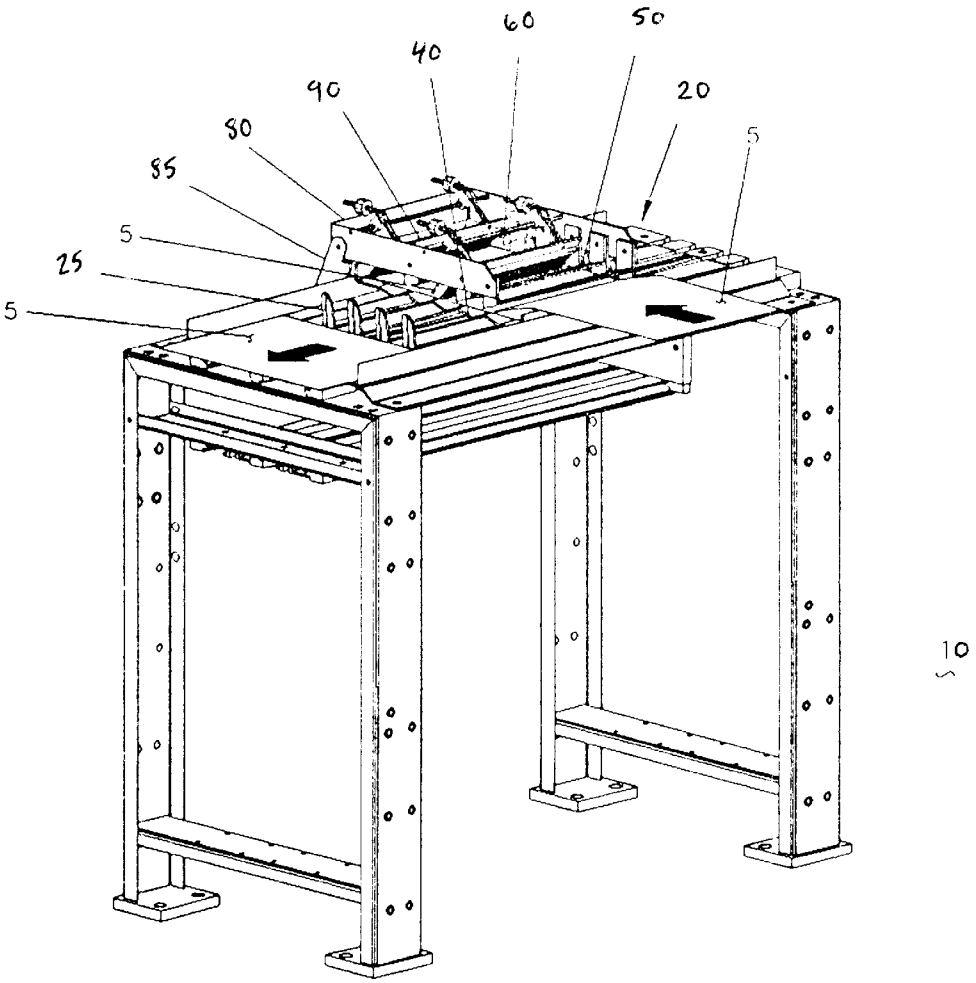
FIG. 1 is a perspective view of the preferred embodiment of the present invention in use on a segment of a transport system.

While the invention is suspectable of embodiment in many different forms they are shown in the drawings and will be described herein in detail a preferred embodiment of the invention. It should be understood however that the present disclosure is to be considered an exemplification of the principals of the invention and is not intended to limit the spirit and scope of the invention and/or claims of the embodiment illustrated.

FIG. 1 illustrates the present invention 10 mounted above one segment of a transport 20 having transports picks 25. The present invention 10 comprises a series of bottom guides 40, a series of top guides 50, and a series of side restraints 60 all mounted to a framework 80 which is mounted just above the transport via a provision 85. A plurality of paper control devices 90 are also mounted to framework 80 and will be discussed in more detail below.

As indicated by the arrows in FIG. 1 sheet material or insert 5 is fed from the side at a right angle to the transport in between bottom guides 40 and top guides 50 and remains there between until picks 25 of transport 20 engage and remove insert 5 from in between the bottom guides 40 and top guides 50.

Figure 2:
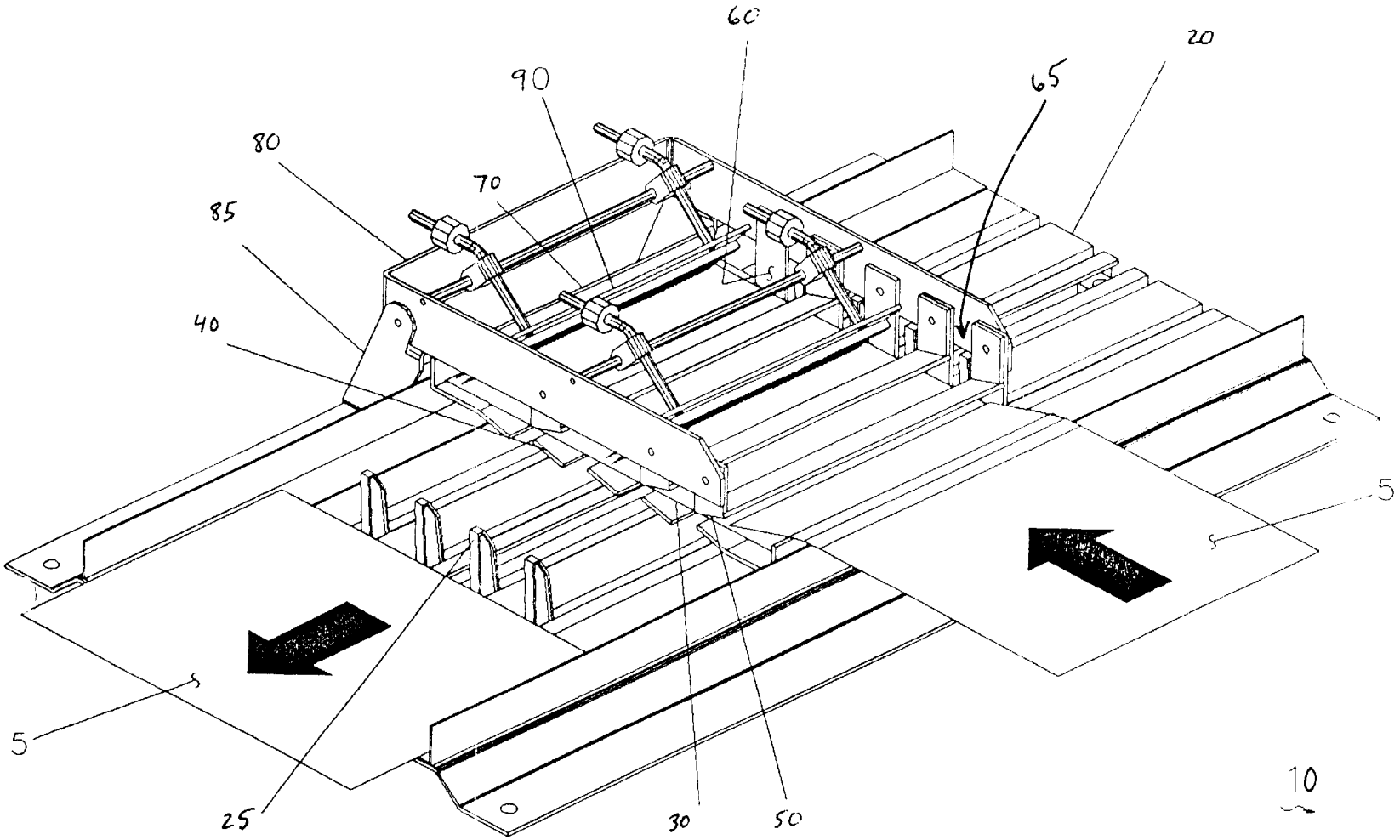
FIG. 2 is an enlarged perspective view of the present invention as seen in FIG. 1.

Referring now to FIG. 2, invention 10 is shown mounted slightly above a transport 20 having a series of aligned transport picks 25. Invention 10 comprises a nest or pocket 30 for receiving sheet material or insert 5 therein. Pocket 30 is defined by a series of bottom guides 40, a series of top guides 50, side restraints 60 on one side of the pocket 30 and a rear backstop 70, all mounted to a framework 80 which is positioned above the transport and mounted thereto via a provision 85. Insert 5 thus is fed into pocket 30 and is restrained by side restraint 60 and rear backstop 70. As can be seen, bottom guides 40 are slightly angled upward such that the leading edge of insert 5 is prevented from dropping in between the series of bottom guides 40. The leading edge of insert 5 rides up each sloped bottom guide and thus skips over the openings therebetween, as each sloped guide acts as a ramp. Similarly, top guides 50 are downwardly sloped to prevent the leading edge of insert 5 from being propelled up into the opening between the series of top guides 50. The series of bottom guides 40, top guides 50 and side restraints 60 are evenly spaced to provide openings or slots 65 for picks 25 to pass therethrough. In this manner, picks 25 approach pocket 30 containing insert 5 therein and upon passing through slots 65 engage insert 5 and propel insert 5 out of the pocket 30, at which time insert 5 drops to the transport.

Also seen in FIG. 2 mounted to framework 80 are paper control devices 90 in the form of brush assemblies. Brush assemblies 90 contact the top surface of insert 5 thus providing a small amount of pressure thereon to allow for proper positioning and better control of insert 5 as it is being fed into pocket 30.

Figure 3:
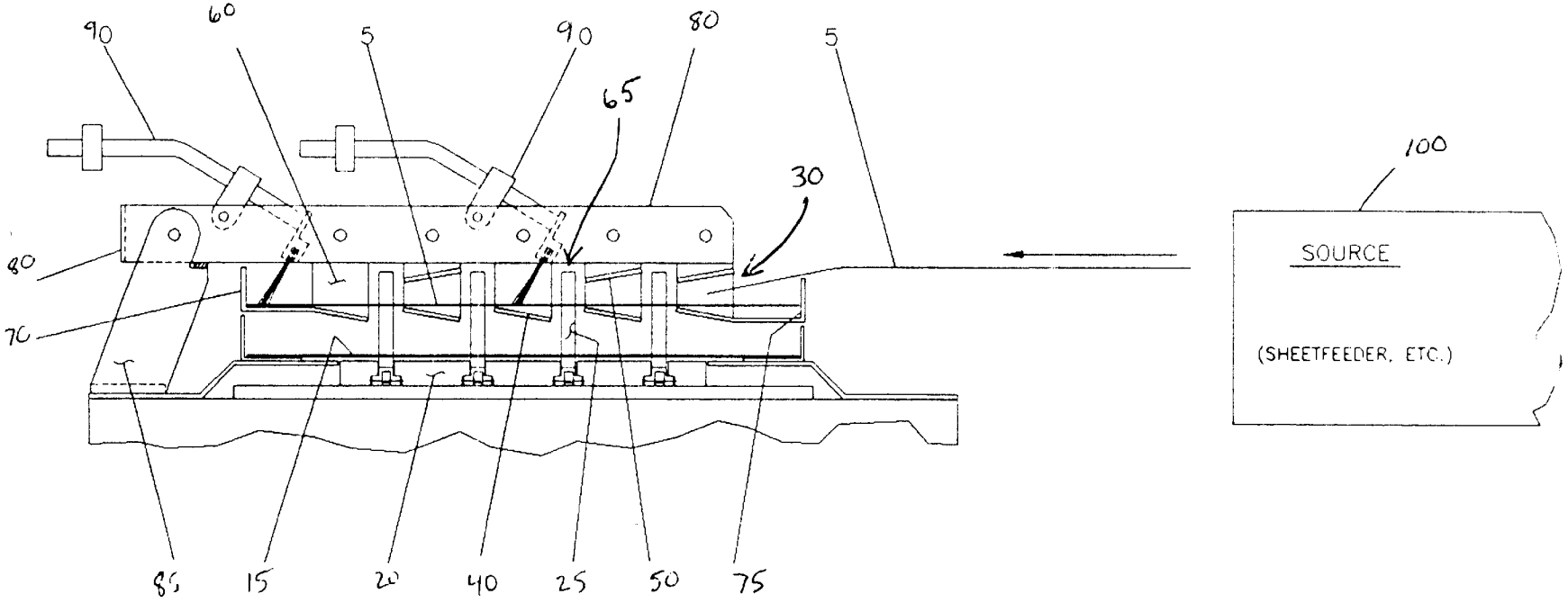
FIG. 3 is a side view of the present invention.

FIG. 3 illustrates a side view of invention 10 wherein a source 100 such as a sheet feeder feeds insert 5 into pocket 30. As can be seen, pocket 30 comprises a series of spaced bottom guides 40, top guides 50 and side restraints 60 having openings or slots 65 therebetween. Pocket 30 further includes a rear back stop 70 and a front back stop 75 combining with side restraints 60 to restrain insert 5 within pocket 30.

As can be seen, bottom guides 40 and top guides 50 are mounted to side restraints 60 which in turn mount to the framework 80 being mounted to and positioned just above the transport 20 via a provision 85. Framework 80 is positioned above the transport at a distance slightly higher than the height of transport picks 25 thus allowing transport picks 25 to pass underneath framework 80 while at the same time allowing bottom guides and top guides 40 and 50 respectively to hold insert 5 at a level above the transport where transport picks 25 will contact and engage and propel insert 5 out of nest or pocket 30 through its open side. Brush assemblies 90 can be seen engaging insert 5 and thus applying slight pressure thereto to insure insert 5 is properly positioned within pocket 30.

For illustration purposes only, FIG. 3 is shown to include an existing sheet material 15 being propelled along the top surface of transport 20 by picks 25. Accordingly, when picks 25 engage insert 5 and propel insert 5 out of pocket 30, insert 5 subsequently falls from pocket 30 onto existing sheet 15. In this manner the merged insert material can be stacked evenly on top of existing sheets as desired.

In operation, the present invention allows sheet material from two streams to be merged and stacked evenly without damage to the edges. These two streams are at right angles to each other. Various sensors can be placed in and around pocket 30 to sense if an insert is presently in pocket 30, at which time source 100 can receive a signal to prevent additional inserts from being inserted into pocket 30 until insert 5 is removed from pocket 30. The present invention can be used in applications requiring documents to be delivered from the transport from more than a single source. One or more units may be installed as needed or where permitted by source device configuration. The right angle merge pocket becomes active only when being fed with insert 5 and therefore does not interfere with the flow of existing sheet material 15 along the transport when pocket 30 is not being used. Alternatively, if desired, a plurality of inserts may be fed into the pocket. The pocket preferably may hold material up to ½ inch in thickness.

Brush assemblies 90 serve to dampen bouncing of insert 5 as it is propelled into pocket 30 and helps to keep insert 5 contained in pocket 30. Testing has shown that inserts can be successfully merged at right angles to a constant running transport and the present invention can stack sheets one on top of the other at a rate of up to 10,000 packets per hour.

It is to be understood that the embodiment herein described is merely illustrative of the principles of the present invention. Various modifications may be made by those skilled in the art without departing from the spirit or scope of the claims which follow:

What is claimed is:

1. An apparatus for merging sheet material from a source onto a transport having picks moving in a direction, said apparatus comprising:

a means for receiving sheet material from the side of the transport and holding said sheet material above said transport in such a manner to allow said picks to engage said sheet material and remove said sheet material from said means for receiving and holding.

2. The apparatus of claim 1, wherein said means define a front entry opening running parallel to said direction of the moving picks.

3. The apparatus of claim 1, wherein said means define a side exit opening running perpendicular to said direction of the moving picks.

4. The apparatus of claim 1, wherein said means define slots to allow said picks to pass through said means and engage said sheet material.

5. The apparatus of claim 1, wherein said means defines a pocket and includes a plurality of bottom guides to guide and support said sheet material in said pocket.

6. The apparatus of claim 5, wherein said means further includes a plurality of top guides to guide said sheet material into said pocket.

7. The apparatus of claim 5, wherein said means further includes a rear backstop.

8. The apparatus of claim 5, wherein said means further includes side restraints on one side of said pocket.

9. The apparatus of claim 5, wherein said means further includes paper control means for controlling movement of said sheet material in said pocket.

10. An apparatus for allowing the merging of sheet material from a sheet feeder onto a high speed document transport having a series of aligned picks moving in a direction, said apparatus comprising:

means defining a pocket for receiving and supporting said sheet material, said means suitably mounted above said transport and including a plurality of bottom and top guides for guiding said sheet material into said pocket and supporting said sheet material therebetween;

said pocket defining a front entry opening for receiving said sheet material from said sheet feeder, and a side exit opening for allowing said sheet material to exit therefrom;

said pocket further defining a plurality of slots between said plurality of bottom and top guides for allowing said picks to pass through said pocket and engage and propel said sheet material through said side exit opening and out of said pocket and onto said transport.

11. The apparatus of claim 10, wherein said means further includes side restraints on a side of the pocket opposite said side exit opening, and rear and front backstops.

12. The apparatus of claim 10, wherein said means further includes brush assemblies extending into said pocket for controlling movement of said sheet material in said pocket.

13. The apparatus of claim 10, wherein said front entry opening is perpendicular to said side exit opening.

14. A method of merging sheet material onto a high speed transport having a series of aligned moving picks, said method comprising the steps of:

mounting a means defining a pocket above said transport;

defining a front entry opening, a side exit opening, and a plurality of slots in said pocket;

feeding a sheet material through said front entry opening and into said pocket;

passing said moving picks through said slots in said pocket;

engaging and pushing said sheet material with said picks through said side exit opening and onto said transport.

15. The method of claim 14, further comprising the step of repeating the steps of claim 14 a predetermined number of times.

16. The method of claim 14, further comprising the step of controlling the movement of said sheet material while inside said pockets.

17. An apparatus for the improved merging of an item onto a transport having at least one pusher element, said apparatus comprising:

a support structure mounted above said transport, said support structure having at least one passageway for allowing said at least one pusher element to pass therethrough, said support structure receiving and supporting said item above said transport until said at least one pusher element passes through said at least one passageway.

18. The apparatus of claim 17 wherein said at least one passageway defines a plurality of slots, and said at least one pusher element defines a plurality of picks, said plurality of slots being aligned with said plurality of picks, said plurality of picks engaging and removing said item from said support structure upon passing through said plurality of slots.

19. A method for merging an item onto a transport having at least one pusher element, said method comprising the steps of:

mounting a support structure above said transport;

defining at least one passageway in said support structure;

feeding said item onto said support structure;

passing said at least one pusher element through said at least one passageway in said support structure; and engaging and pushing said item with said at least one pusher element off of said support structure and onto said transport.

20. The method of claim 19, further comprising the step of repeating the steps of claim 19 a number of times.

21. The apparatus of claim 1, wherein said means for receiving and holding supports said sheet material above said transport.

* * * * *